US011253095B2

(12) United States Patent
Carlson

(10) Patent No.: US 11,253,095 B2
(45) Date of Patent: Feb. 22, 2022

(54) PARCEL DROP BOX

(71) Applicant: Ronald Carlson, Oklahoma City, OK (US)

(72) Inventor: Ronald Carlson, Oklahoma City, OK (US)

( * ) Notice: Subject to any disclaimer, the term of this patent is extended or adjusted under 35 U.S.C. 154(b) by 0 days.

(21) Appl. No.: 17/365,309

(22) Filed: Jul. 1, 2021

(65) Prior Publication Data

US 2021/0321809 A1 Oct. 21, 2021

Related U.S. Application Data

(60) Provisional application No. 63/182,653, filed on Apr. 30, 2021.

(51) Int. Cl.

| | |
|---|---|
| ***A47G 29/124*** | (2006.01) |
| ***A47G 29/16*** | (2006.01) |
| ***A47G 29/20*** | (2006.01) |
| ***A47G 29/12*** | (2006.01) |

(52) U.S. Cl.

CPC ..... *A47G 29/1251* (2017.08); *A47G 29/1209* (2013.01); *A47G 29/16* (2013.01); *A47G 29/20* (2013.01)

(58) Field of Classification Search

CPC .... A47G 29/16; A47G 29/1209; A47G 29/20; A47G 29/1248; A47G 29/1251; A47G 29/12095

USPC ..... 232/17, 19, 20, 21, 27, 43.1, 45, 47, 48, 232/51

See application file for complete search history.

(56) References Cited

U.S. PATENT DOCUMENTS 132,865 A * 11/1872 Sinclaire ..... A47G 29/12095 232/48
400,299 A * 3/1889 Chappell et al. ..... A47G 29/12095 232/48
413,928 A * 10/1889 Cook ..... A47G 29/1207 232/48
455,373 A * 7/1891 Wesson ..... A47G 29/1225 232/36
741,865 A * 10/1903 Williams ..... A47G 29/12095 232/48
807,764 A * 12/1905 Mowers et al. . A47G 29/12095 232/48
1,111,031 A * 9/1914 Petri ..... A47G 29/12095 232/48
4,753,386 A * 6/1988 Phillion, Sr. ..... A47G 29/121 232/43.1

(Continued)

*Primary Examiner* — William L Miller
(74) *Attorney, Agent, or Firm* — Barry Choobin; Patent 360

(57) ABSTRACT

A parcel drop box for receiving a parcel in the presence or absence of a receiver of the parcel. The parcel drop box includes a cuboidal enclosure with an open-top. A lid pivotally covers the open-top and can be lifted for gaining access into the interior of the enclosure. A pair of flaps coupled inside the enclosure to the sidewalls and just below a periphery of the open-top. The flaps can pivot between a horizontal position and a downward vertical position. The lid is coupled to the pair of flaps, such as pivoting of the lid results in pivoting of the flaps. Opening of the lid results in pivoting of the flaps to a horizontal position which restricts the access to the interior of the enclosure from the open-top i.e., the pair of flaps substantially cover the open-top when in the horizontal position.

15 Claims, 2 Drawing Sheets

(56) References Cited

U.S. PATENT DOCUMENTS

| | | | | |
|---|---|---|---|---|
| 5,435,484 | A * | 7/1995 | Carlson | A47G 29/1251 232/47 |
| 6,588,656 | B2 * | 7/2003 | Cox | A47G 29/16 232/47 |
| 7,036,719 | B1 * | 5/2006 | Helphrey | A47G 29/12095 232/47 |
| 7,607,569 | B2 * | 10/2009 | Van Rossum | A47G 29/12095 232/48 |
| 7,854,374 | B2 * | 12/2010 | Dudley | A47G 29/12095 232/45 |
| 10,368,676 | B1 * | 8/2019 | Ansari | A47G 29/1251 |

* cited by examiner

PARCEL DROP BOX

CROSS-REFERENCE TO RELATED APPLICATIONS

This application claims priority from the U.S. provisional patent application Ser. No. 63/182,653, filed on Apr. 30, 2021, which is incorporated herein by reference in its entirety.

FIELD OF INVENTION

The present invention relates to a parcel drop box, and more particularly, the present invention relates to a drop box that has a trap door to prevent theft of parcels.

BACKGROUND

Delivery of goods to home through courier services has increased manifold in last few years. More people are preferring online shopping, wherein the goods are delivered to the customer's address via courier. Moreover, the retailers are also preferring to send goods to the customers from their warehouses saving costs.

However, a customer may not always be present at home to collect a parcel. Moreover, nobody may be available at the customer's address to receive the parcel on behalf of the customer. The courier service provider, in such a case, may return the item to the sender or may reattempt the delivery the next day. In either case, the delivery parcel is delayed and the cost of parcel delivery also increases. Leaving the parcel at door can also be not practical considering the risk of theft and damage. Thus, considering the increase in home deliveries of goods in the last few decades, a desire is there for an apparatus and method that allow safe receipt of a parcel in the absence of the customer.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a parcel drop box that has a one-way door for receiving the parcels.

It is another object of the present invention that the disclosed parcel drop box can be easily installed both indoors and outdoors.

It is still another object of the present invention that the parcel drop box can keep the goods safe from theft and damage.

It is yet another object of the present invention that the parcel drop box can receive parcels in the absence of a receiver.

It is a further object of the present invention that the parcel drop box does not require electricity for operation.

It is still a further object of the present invention that the parcel drop box can also receive letters.

It is yet a further object of the present invention that the parcel drop box can also hold outgoing letters for pickup.

It is an additional object of the present invention that any new parcel or mail can be visible from a distance.

In one aspect, disclosed is a parcel drop box that includes an enclosure having a base, sidewalls, and an open-top, the enclosure has a left side, a right side, a rear side, and a front side, the left and right sides are opposite to each other; a passage in one of the sidewalls for gaining access into an interior of the enclosure; a door covering the passage, the door configured to switch between a closed position and an open position, wherein the door can be switched from the closed position to the open position for gaining access into the interior of the enclosure, wherein switching of the door is secured by a lock; a lid configured to rest upon a rim of the open-top for covering the open-top, the lid pivotally coupled to the left side of the enclosure, the lid configured to switch between a rest position and a lifted position, wherein the lid covers the open-top of the enclosure in the rest position, the open-top of the enclosure is accessible in the lifted position, the lid has a top surface and a bottom surface; a first flap that has a front edge and a rear edge, the rear edge pivotally coupled to an inner surface of the left side of the enclosure just below a periphery of the open-top; a second flap that has a front edge and a rear edge, the rear edge of the second flap pivotally coupled to an inner surface of the right side of the enclosure just below the periphery of the open-top; a first cord extends from the lid and coupled to the first flap; and a second cord extends from the lid and coupled to the second flap, wherein each the first flap and the second flap are mounted at a same height, wherein each the first flap and the second flap are configured to pivot about 90 degrees between a substantially horizontal position and a downward vertical position, wherein each the first flap and the second flap in the substantially horizontal position have their front edges adjacent to each other and substantially covers the open-top of the enclosure, wherein a length of the first cord and a length of the second cord are such that lifting the lid results in pivoting of the first flap and the second flap from the downward vertical position up to the substantially horizontal position, wherein the length of the second cord is larger than the length of the first cord.

In one implementation of the parcel drop box, the parcel drop box is further configured such as upon releasing the lid from the lifted position to the rest position results in pivoting of the first flap and the second flap from the substantially horizontal position to the downward vertical position. The first cord and the second cord extend from the bottom surface of the lid. The parcel drop box further includes a passage in a wall of the sidewalls, wherein the passage is dimensioned such as a parcel can be removed from the enclosure; and a door pivotally coupled to the wall and dimensioned to cover the passage, the door configured to pivot between an open position and a closed position, the passage is accessible in the open position of the door, the passage is closed in the closed position of the door, where the door is secured by a lock. The lid is pivotally coupled to the left side of the enclosure through a hinge joint. The parcel drop box further includes an elongated slot in a wall of the sidewalls, the elongated slot dimensioned to receive a letter. The parcel drop box can further includes an outbox coupled to a wall of the sidewalls of the enclosure.

In one aspect, disclosed is a method of receiving a parcel, the method includes the steps of providing the disclosed parcel drop; lifting the lid to the lifted position; upon lifting the lid, placing the parcel on the first flap and the second flap, wherein the first flap and the second flap are in the substantially horizontal position; and upon placing the parcel, releasing the lid from the lifted position to the rested position resulting in the pivoting of the first flap and the second flap to the downward vertical position and falling of the parcel in the enclosure.

In one implementation of the method, the method further includes the steps of: upon releasing the lid, unlocking the door; and removing the parcel from the enclosure. The method may further include the steps of receiving the letter through the elongated slot, wherein the letter falls into the enclosure. The method may further include the steps of: receiving a letter in the outbox; opening the cover; and upon opening the cover, removing the letter from the outbox.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
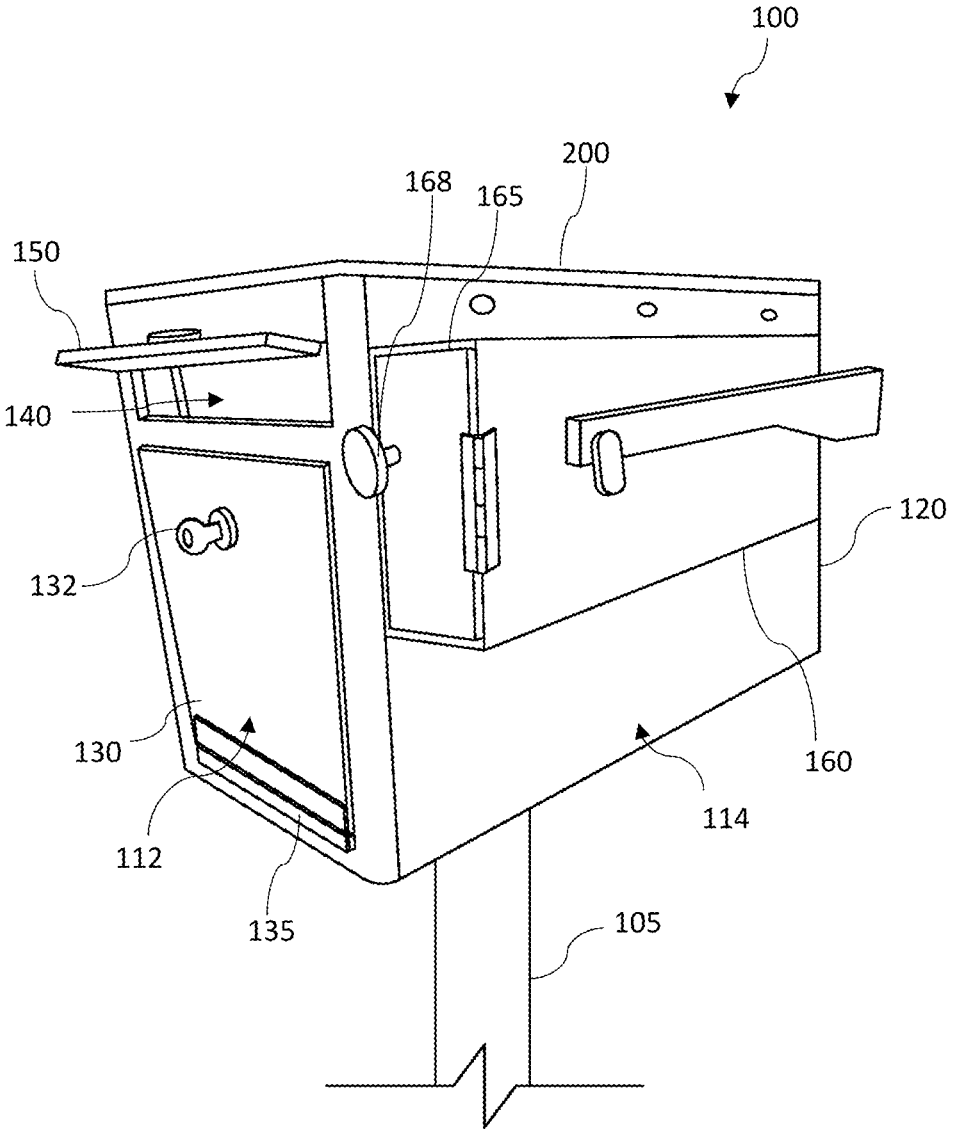
FIG. 1 is a perspective view of the parcel drop box, according to an exemplary embodiment of the present invention.
Figure 2:
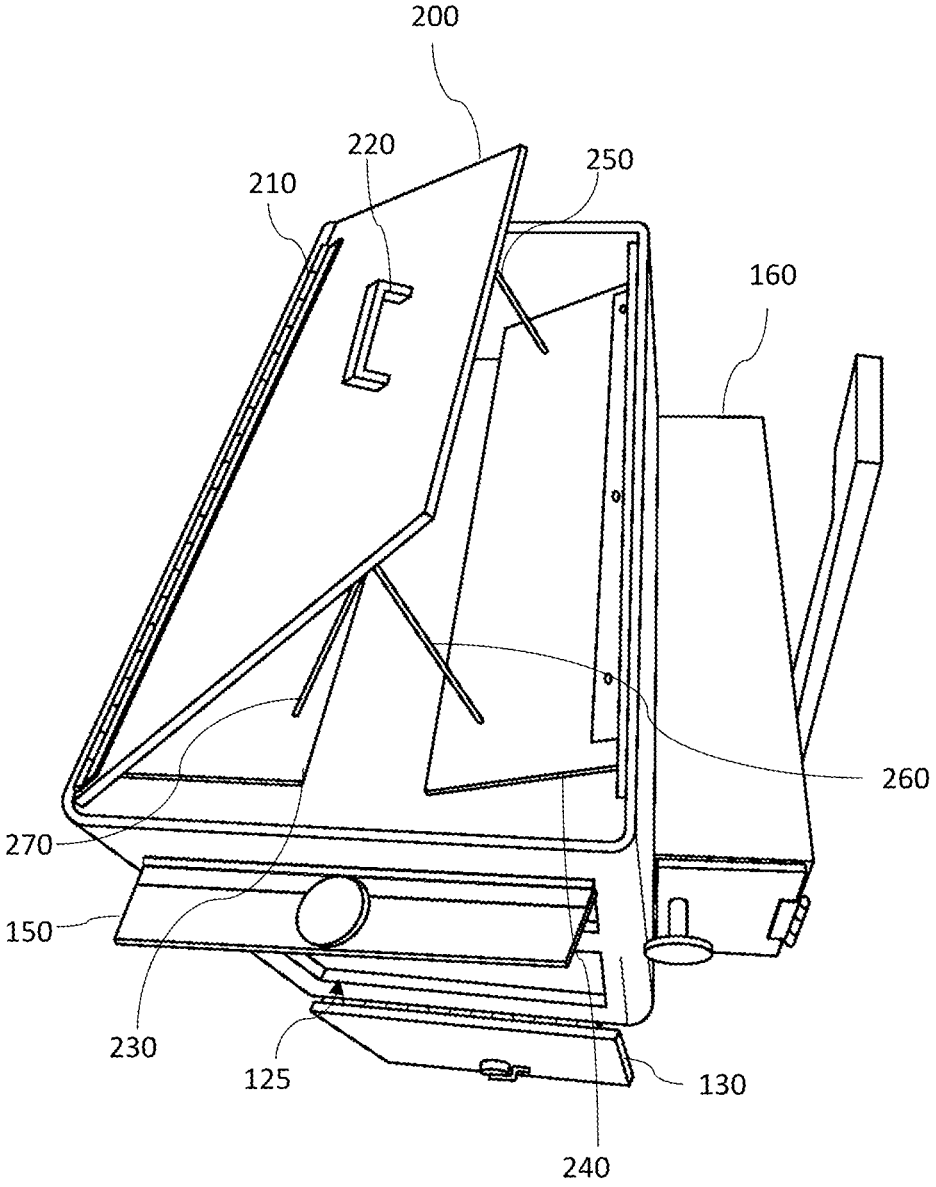
FIG. 2 shows a lid of the parcel drop box opened and inside two flaps pivoted upwards, according to an exemplary embodiment of the present invention.

Disclosed is a parcel drop box that can be used to receive parcels safely in the presence or absence of the receiver of the parcel. The parcels in the parcel drop box can be protected against both theft and damage. The received parcels in the parcel drop box can only be taken out through a secure door provided in the parcel drop box. The disclosed parcel drop box can be mounted both indoors and outdoors. The parcel drop box can be mounted to an upstanding pole or a wall. Referring to FIGS. 1 and 2 which shows an implementation of the disclosed parcel drop box. FIG. 1 shows the parcel drop box 100 of a cuboid shape that is mounted to an upstanding pole 105. The parcel drop box 100 can have a frame to which can be mounted a base, and side walls forming an enclosure 120. The top of the enclosure can be open, such as to receive a parcel. The sidewalls of the enclosure can include a left side, a right side, a front side, and a rear side. The left and the right sides can be opposite to each other. FIG. 1 shows the front side 112 and the rear side 114 of the enclosure 120. It is to be understood that the enclosure can be made from a skeleton frame to which the panels can be mounted forming the base and sidewalls of the enclosure. Alternatively, the frame can be optional and the panels can be assembled to form the enclosure. The panels can be made from a durable and sturdy material, such as plastic or wood. In one case, the enclosure can be made from a transparent or translucent material, such as a transparent plastic that allows contents within the enclosure to be visible from the outside. Alternatively, only one side of the enclosure can be made transparent. Still, alternatively, a transparent window can be provided. The provision of such a transparent window may allow viewing the content of the enclosure from a distance without opening the lid of the enclosure.

The top of the enclosure is open to receive a parcel. The front side of the enclosure can have a passage 125 for gaining access into the enclosure, wherein the passage 125 can be covered by a door 130 coupled to the front side 112 of the enclosure 120. The door 130 can be pivotally coupled, such as using a hinge joint. The hinge joint can be coupled vertically or horizontally, such as the door can be opened sidewards, upwards, or downwards. FIG. 1 shows a hinge joint 135 at the bottom of the door 130, such as the door 130 can pivot downwards. It is to be understood that FIG. 1 shows the door on the front side of the enclosure, however, the door can also be provided on the left side, right side, or rear side of the enclosure without departing from the scope of the present invention. A lock 132 can also be provided to secure the door 130.

Above the door, 130 can also be seen an elongated slot 140 that extends along a width of the enclosure 120 i.e., horizontally. Slot 140 can be dimensioned to receive a standard size letter. The width and length of the slot 140 can be such as to allow letters to be inserted but not big enough for the hand to be inserted inside. The inserted letter can fall into the enclosure. The slot 140 also allows the disclosed parcel drop box 100 to be used as a mailbox, wherein the letters can be easily dropped in the parcel box. The slot 140 can be covered by a hinged door 150 coupled to the front side of the enclosure 120. The hinged door 150 can be pivotally coupled to the front side 112 of the enclosure 120 and can open upwards and outwards. A handle can also be provided on the hinged door 150, which allows pulling the hinged door 150 upwards for dropping the letters. The hinged door 150 for the elongated slot can also be replaced by a hanging rigid curtain that can be swively coupled to the sides of the elongated slot 140. The mail being inserted into the elongated slot 140 can push the curtain backward and the mail can be dropped into the enclosure 120. Also, it is to be understood that the elongated slot 140 for mails can be provided on other sides of the enclosure such as left, right, or rear sides without departing from the scope of the present invention. Also, such a provision of a slot for letter mails can be optional. Moreover, the hinged door 150 or rigid curtain or any other covering means for the elongated slot 140 can also be optional. For example, the elongated slot can be provided without any cover or door.

On the right side of the parcel drop box 100 can be a small enclosure that can be an outbox 160 coupled to the side of the enclosure 120. The outbox 160 can be used for outgoing letters, postcards, and postal mails. For example, the mails that have to be picked by a courier can be placed in the outbox 160. The outbox 160 can also be provided with a hinged door 165 and a handle 168.

The open-top of the enclosure can be covered by a lid 200 wherein the lid 200 can be pivotally coupled to the enclosure. Hinge joints 210 can be used to mount the lid 200 to the enclosure 120. FIGS. 1 and 2 show the lid 200 coupled to the left side of the enclosure 120. The lid can rest upon a rim of the enclosure along the open-top. The lid 200 can have a top surface and a bottom surface. The top surface of the lid can be provided with a handle 220 that can be grasped to lift the lid upwards for gaining access into the interior of the enclosure. Two flaps can also be seen mounted to the opposite sides of the enclosure. FIG. 2 shows the two flaps, wherein the first flap 230 is mounted on an inner surface of the left side and the second flap 240 can be mounted to an inner surface of the right side of the enclosure 120. Both the lid and the flaps can be preferably mounted to a longer side of the enclosure. In FIG. 2, the left and right sides are the longer sides of the enclosure 120. The flaps can be mounted just below a periphery of the open-top of the enclosure 120. The first flap 230 and the second flap 240 can be pivotally coupled to the opposite sides of the enclosure such as the flaps can freely pivot about 90 degrees between a downward vertical position and a horizontal portion. The two flaps can be mounted at the same heights. Each flap can have a front edge and a rear edge, wherein the rear edges of the two flaps can be coupled to the opposite sides of the enclosure while the front edges of the two flaps can move towards and away from each other. while moving toward each other i.e., from the downward vertical position to the horizontal position, the two flaps gradually close the opening of the enclosure i.e., the open-top. The opening of the open-top of the enclosure gradually narrows down till the two flaps are horizontally aligned.

The dimension of the two flaps can be such that when mounted to the opposite sides of the enclosure, a small gap can be there between the sidewalls of the enclosure and the edges of the flap. The length of the flaps can be slightly less than a length of the enclosure, such as the flap can freely pivot within the enclosure without touching the sides. The length of the enclosure can be the length between the inner surfaces of the enclosure. Similarly, the width of each flap can be slightly less than half the width of the enclosure, the width of the enclosure between inner surfaces of the enclosure. Two flaps can pivot upwards in a horizontal plane, such as both the flaps can lie in the same plane, the plane parallel to the base of the enclosure. A small gap can be there between the two adjacent front edges of the flaps.

Furthermore, it can be seen in FIG. 2 are cords that extend between the bottom surface of the lid and the two flaps. Each of the two flaps can be suspended by cords that extend from the bottom surface of the lid. The length of the cords can be such that when the lid is in a closed position, the two flaps can lie substantially in a downward vertical position and the open-top of the enclosure is accessible from the open-top. When the lid is lifted upwards, the two flaps also pivot upwards till be in the horizontal position. When the lid is lifted, the two flaps can close the open-top of the enclosure. The length of the cords can be adjusted to permit the desired degree of opening of the lid. For example, some free play can be provided by lengthening the cord, such as the lid can be opened at a wider angle. Two or four cords can preferably be provided to suspend the flaps from the lids. FIG. 1 shows the first cord 250 and the second cord 260 coupling the second flap 240 to the lid 200. A third cord (not shown) and a fourth cord 270 couples the first flap 230 to the lid 200. It is to be understood that the flap can be suspended by a single cord or more than one cords without departing from the scope of the present invention. The cords can be made from a flexible and sturdy material, such as nylon.

To place a parcel in the disclosed parcel box, a person can lift the lid by grasping the handle and pulling it upwards. This upwards movement of the lid can also pull the two flaps upwards closing the open-top of the enclosure. The parcel can then be placed on the two flaps and thereafter the lid can be released. The lid moves downwards to rest upon the rim in the closed position, the two flaps can pivot downwards, and the parcel placed on the two flaps falls into the enclosure. Such a procedure prevents theft of the parcel since the opening of the lid results in pivoting of the two flaps upwards closing the open-top. The two flaps in a substantially horizontally position prevent removing the parcel in the enclosure. As the lid is lifted, the two flaps pivot upwards narrowing the opening of the enclosure. The narrow passage may also prevent any forceful withdrawal of the package.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A parcel drop box comprising:

an enclosure having a base, sidewalls, and an open-top, the enclosure has a left side, a right side, a rear side, and a front side, the left and right sides are opposite to each other;

a passage in one of the sidewalls for gaining access into an interior of the enclosure;

a door covering the passage, the door configured to switch between a closed position and an open position, wherein the door can be switched from the closed position to the open position for gaining access into the interior of the enclosure, wherein switching of the door is secured by a lock;

a lid configured to rest upon a rim of the open-top for covering the open-top, the lid pivotally coupled to the left side of the enclosure, the lid configured to switch between a rest position and a lifted position, wherein the lid covers the open-top of the enclosure in the rest position, the open-top of the enclosure is accessible in the lifted position, the lid has a top surface and a bottom surface;

a first flap that has a front edge and a rear edge, the rear edge pivotally coupled to an inner surface of the left side of the enclosure just below a periphery of the open-top;

a second flap that has a front edge and a rear edge, the rear edge of the second flap pivotally coupled to an inner surface of the right side of the enclosure just below the periphery of the open-top;

a first cord extends from the lid and coupled to the first flap; and a second cord extends from the lid and coupled to the second flap, wherein each the first flap and the second flap are mounted at a same height, wherein each the first flap and the second flap are configured to pivot about 90 degrees between a substantially horizontal position and a downward vertical position, wherein each the first flap and the second flap in the substantially horizontal position have their front edges adjacent to each other and substantially covers the open-top of the enclosure, wherein a length of the first cord and a length of the second cord are such that lifting the lid results in pivoting of the first flap and the second flap from the downward vertical position up to the substantially horizontal position.

2. The parcel drop box according to claim 1, wherein the parcel drop box is further configured such as upon releasing the lid from the lifted position to the rest position results in pivoting of the first flap and the second flap from the substantially horizontal position to the downward vertical position.

3. The parcel drop box according to claim 1, wherein the first cord and the second cord extend from the bottom surface of the lid.

4. The parcel drop box according to claim 1, wherein the passage is dimensioned such that a parcel can be removed from the enclosure.

5. The parcel drop box according to claim 4, wherein the parcel drop box further comprises an elongated slot in a wall of the sidewalls, the elongated slot dimensioned to receive a letter.

6. The parcel drop box according to claim 5, wherein the passage and the elongated slot are on the front side of the enclosure, the elongated slot is above the passage.

7. The parcel drop box according to claim 4, wherein the parcel drop box further comprises an outbox coupled to a wall of the sidewalls of the enclosure.

8. The parcel drop box according to claim 1, wherein the lid is pivotally coupled to the left side of the enclosure through a hinge joint.

9. The parcel drop box according to claim 1, wherein the sidewalls and the lid are transparent.

10. The parcel drop box according to claim 1, wherein at least one wall of the sidewalls is transparent.

11. The parcel drop box according to claim 1, wherein the length of the second cord is larger than the length of the first cord.

12. A method of receiving a parcel, the method comprising the steps of:

providing a parcel drop box, the parcel drop box comprising:

an enclosure having a base, sidewalls, and an open-top, the enclosure has a left side, a right side, a rear side, and a front side, the left and right sides are opposite to each other, a passage in one of the sidewalls for gaining access into an interior of the enclosure, a door covering the passage, the door configured to switch between a closed position and an open position, wherein the door can be switched from the closed position to the open position for gaining access into the interior of the enclosure, wherein switching of the door is secured by a lock, a lid configured to rest upon a rim of the open-top for covering the open-top, the lid pivotally coupled to the left side of the enclosure, the lid configured to switch between a rest position and a lifted position, in the rest position the lid covers the open-top of the enclosure, in the lifted position the open-top of the enclosure is accessible, the lid has a top surface and a bottom surface, a first flap that has a front edge and a rear edge, the rear edge pivotally coupled to an inner surface of the left side of the enclosure just below a periphery of the open-top, a second flap that has a front edge and a rear edge, the rear edge of the second flap pivotally coupled to an inner surface of the right side of the enclosure just below the periphery of the open-top, a first cord extends from the lid and coupled to the first flap, and a second cord extends from the lid and coupled to the second flap, wherein each the first flap and the second flap are mounted at a same height, wherein each the first flap and the second flap are configured to pivot about 90 degrees between a substantially horizontal position and a downward vertical position, wherein each the first flap and the second flap in the substantially horizontal position have their front edges adjacent to each other and substantially covers the open-top of the enclosure, wherein a length of the first cord and a length of the second cord are such that lifting the lid results in pivoting of the first flap and the second flap from the downward vertical position up to the substantially horizontal position;

lifting the lid to the lifted position;

upon lifting the lid, placing the parcel on the first flap and the second flap, wherein the first flap and the second flap are in the substantially horizontal position; and upon placing the parcel, releasing the lid from the lifted position to the rested position resulting in the pivoting of the first flap and the second flap to the downward vertical position and falling of the parcel in the enclosure.

13. The method according to claim 12, wherein the passage is dimensioned such that the parcel can be removed from the enclosure, wherein the method further comprises the steps of:

upon releasing the lid, unlocking the door; and removing the parcel from the enclosure.

14. The method according to claim 12, wherein the parcel drop box further comprises an elongated slot in a wall of the sidewalls, the elongated slot dimensioned to receive a letter, wherein the method further comprises the steps of receiving the letter through the elongated slot, wherein the letter falls into the enclosure.

15. The method according to claim 12, wherein the parcel drop box further comprises an outbox coupled to a wall of the sidewalls, the outbox has a cover, wherein the method further comprises the steps of:

receiving a letter in the outbox;

opening the cover; and upon opening the cover, removing the letter from the outbox.

* * * * *